US010018370B2

(12) United States Patent
Grabinger et al.

(10) Patent No.: US 10,018,370 B2
(45) Date of Patent: Jul. 10, 2018

(54) ECONOMIZER/DCV CONTROLLER WITH MANUAL SENSOR CALIBRATION

(75) Inventors: Cory Grabinger, Maple Grove, MN (US); Adrienne Thomle, Plymouth, MN (US); Miroslav Mikulica, Brno (CZ)

(73) Assignee: Honeywell International Inc., Morris Plains, NJ (US)

( * ) Notice: Subject to any disclaimer, the term of this patent is extended or adjusted under 35 U.S.C. 154(b) by 1312 days.

(21) Appl. No.: 12/890,380

(22) Filed: Sep. 24, 2010

(65) Prior Publication Data

US 2012/0078563 A1 Mar. 29, 2012

(51) Int. Cl.
*F24F 11/00* (2018.01)

(52) U.S. Cl.
CPC ..... *F24F 11/006* (2013.01); *F24F 11/001* (2013.01); *F24F 11/0001* (2013.01)

(58) Field of Classification Search
CPC ..... F24F 11/001; F24F 11/0086
USPC ..... 702/104
See application file for complete search history.

(56) References Cited

U.S. PATENT DOCUMENTS

| | | | | |
|---|---|---|---|---|
| 3,979,922 A | | 9/1976 | Shavit | |
| 4,182,180 A | | 1/1980 | Mott | |
| 4,347,712 A | | 9/1982 | Benton et al. | |
| 4,379,484 A | | 4/1983 | Lom et al. | |
| 4,415,896 A | * | 11/1983 | Allgood | 340/870.03 |
| 4,423,364 A | | 12/1983 | Kompelien et al. | |
| 4,570,448 A | | 2/1986 | Smith | |
| 4,580,620 A | | 4/1986 | Fukumoto et al. | |
| 4,605,160 A | | 8/1986 | Day | |
| 4,933,633 A | * | 6/1990 | Allgood | 324/142 |
| 5,276,630 A | | 1/1994 | Baldwin et al. | |
| 5,292,280 A | * | 3/1994 | Janu et al. | 454/229 |
| 5,418,131 A | * | 5/1995 | Butts | 435/3 |

(Continued)

FOREIGN PATENT DOCUMENTS

| | | |
|---|---|---|
| WO | WO 90/14556 | 11/1990 |
| WO | WO 2009/061293 | 5/2009 |

OTHER PUBLICATIONS

Digi-Sense, "Humidity Meter", Jun. 2004, Oakton Instruments, pp. 13, 17-19 http://www.coleparmer.com/Assets/manual_pdfs/37003-10.pdf.*

(Continued)

*Primary Examiner* — Regis Betsch
(74) *Attorney, Agent, or Firm* — Seager Tufte & Wickhem LLP

(57) ABSTRACT

An economizer controller with sensor calibration. A controller sensor may be used to measure a parameter. At the same time at the same location of the measurement with the controller sensor, a measurement of the same parameter may be made with a precision sensor. The difference between the two measurements may be saved to a controller memory as an offset. The offset may be used to compensate future measurements of the same parameter by the controller sensor. Additional offsets at various magnitudes may be obtained between the precision and the controller sensors for compensating subsequent measurements by the controller sensor. Measurements with the compensated sensor may be used for calibrating sensors in other economizer controllers, for example, at remote locations in the field.

19 Claims, 2 Drawing Sheets

(56) References Cited

U.S. PATENT DOCUMENTS

| | | | | |
|---|---|---|---|---|
| 5,719,408 | A | 2/1998 | Yamamoto et al. | |
| 5,762,420 | A | 6/1998 | Mills | |
| 5,791,408 | A | 8/1998 | Seem | |
| 5,801,940 | A | 9/1998 | Russ et al. | |
| 5,874,736 | A * | 2/1999 | Pompei | 250/338.1 |
| 6,006,142 | A | 12/1999 | Seem et al. | |
| 6,161,764 | A | 12/2000 | Jatnicks | |
| 6,223,544 | B1 | 5/2001 | Seem | |
| 6,249,100 | B1 | 6/2001 | Lange | |
| 6,415,617 | B1 | 7/2002 | Seem | |
| 6,578,770 | B1 * | 6/2003 | Rosen | 236/49.3 |
| 6,609,967 | B2 | 8/2003 | Sharp et al. | |
| 6,778,945 | B2 | 8/2004 | Chassin et al. | |
| 6,826,920 | B2 | 12/2004 | Wacker | |
| 6,988,671 | B2 | 1/2006 | DeLuca | |
| 7,378,954 | B2 * | 5/2008 | Wendt | 340/539.11 |
| 7,434,413 | B2 | 10/2008 | Wruck | |
| 2006/0107670 | A1 | 5/2006 | Thomle et al. | |
| 2006/0117769 | A1 | 6/2006 | Helt et al. | |
| 2006/0130502 | A1 | 6/2006 | Wruck et al. | |
| 2007/0289322 | A1 | 12/2007 | Mathews | |
| 2009/0112451 | A1 * | 4/2009 | Justice | 701/115 |
| 2009/0158188 | A1 * | 6/2009 | Bray et al. | 715/771 |
| 2011/0172831 | A1 | 7/2011 | Kreft et al. | |

OTHER PUBLICATIONS

LGC, "Preparation of Calibration Curves", Sep. 2003, LGC Limited, all, http://www.nmschembio.org.uk/dm_documents/lgcvam2003032_xsjgl.pdf.*

Kay et al., A Practical Technique for Minimizing the Number of Measurements in Sensor Signal Conditioning Calibration, Jun. 2005, Texas Instruments, pp. 1-9; http://www.ti.com/lit/an/sboa111/sboa111.pdf.*

Burr-Brown, "PGA309, Programmable Sensor Conditioner", Dec. 2003, First Page; http://pdf.datasheetarchive.com/indexerfiles/Datasheet-018/DSA00313373.pdf.*

California Energy Commission, "2008 Building Energy Efficient Standards for Residential and Nonresidential Buildings," 176 pages, Dec. 2008.

California Energy Commission, "Reference Appendices for the 2008 Building Energy Efficient Standards for Residential and Nonresidential Buildings," 363 pages, Dec. 2008, revised Jun. 2009.

Carrier Corporation, "Getting More for Less, How Demand Controlled Ventilation Increases Air Quality and Reduces Costs," 7 pages, Dec. 1998.

U.S. Appl. No. 12/764,415, filed Apr. 21, 2010.

U.S. Appl. No. 12/764,431, filed Apr. 21, 2010.

U.S. Appl. No. 12/764,446, filed Apr. 21, 2010.

U.S. Appl. No. 12/828,889, filed Jul. 1, 2010.

U.S. Appl. No. 12/890,396, filed Sep. 24, 2010.

FEMP, "Demand-Controlled Ventilation Using $CO_2$ Sensors," Federal Technology Alert, A New Technology Demonstration Publication, 28 pages, Mar. 2004.

Honeywell, "Product Information Sheet," pp. 134-135, prior to Sep. 24, 2010.

Honeywell, "W6210A,D and W7210A,D Solid State Economizer Logic Module," Product Data, 24 pages, prior to Sep. 24, 2010.

Honeywell, "W7212, W7213, W7214 Economizer Logic Modules for Ventilation Control," Product Data, 16 pages, 2004.

Honeywell, "W7212, W7213, W7214 Economizer Logic Modules for Ventilation Control," Product Data, 24 pages, revised Mar. 2010.

Honeywell, "Building Control Systems, Use of Demand Control Ventilation in Your HVAC System," 1 page, Nov. 2005.

Honeywell, Fresh Air Economizer™ Systems, 2 pages, 1999.

http://content.honeywell.com/building/components/pr/econstudy.asp., "Honeywell Hvac—Economizer Study," 3 pages, printed Oct. 21, 2004.

http://www.automatedbuildings.com/releases/mar09/090312111454honeywell.htm, "Honeywell Introduces Economizer Savings Tool and Selectable Dry Bulb Temperature Sensor to Reduce Energy Consumption," 2 pages, Mar. 2009.

http://www.pexsupply.com/Honeywell-W7210A1001-Series-72-Economizer-TwoSPDT . . . , "Series-72-Economizer-TwoSPDT One 2-10VDC," SKU: W7210A1001, 2 pages, printed Sep. 7, 2010.

Kingrey et al., "Checking Economizer Operation," Washington State University Extension Energy Program, 3 pages, Feb. 6, 2009.

New Buildings Institute, "Commercial Rooftop HVAC Energy Savings Research Program, Draft(A) Final Project Report," 99 pages, Mar. 25, 2009.

PurpleSwift, "DC6 AHU Economizer Unit," 2 pages, downloaded Jul. 1, 2010.

Rooftop Systems, Inc., "Economizer Catalog, Version 1.1," 20 pages, downloaded Jul. 1, 2010.

Taylor, "Comparing Economizer Relief Systems," ASHRAE Journal, pp. 33-42, Sep. 2000.

* cited by examiner

ECONOMIZER/DCV CONTROLLER WITH MANUAL SENSOR CALIBRATION

BACKGROUND

The present disclosure pertains to controllers and particularly to economizer controllers. More particularly, the disclosure pertains to compensation of sensors for economizer controllers.

SUMMARY

The disclosure reveals an economizer controller with sensor calibration. A controller sensor may be used to measure a parameter. At the same time, at the same location of the measurement with the controller sensor, a measurement of the same parameter may be made with a precision sensor. The difference between the two measurements may be saved to a controller memory as an offset. The offset may be used to compensate future measurements of the same parameter by the controller sensor. Additional offsets at various magnitudes may be obtained between the precision and the controller sensors for compensating subsequent measurements by the controller sensor. Measurements with the compensated sensor may be used for calibrating sensors in other economizer controllers, for example, at remote locations in the field.

DESCRIPTION

Energy savings and precise environmental control are continually gaining importance as energy costs rise. In the effort to better control, and optimize energy use for environmental controls, the accuracy of the individual sensing elements in the system become more and more important. This drives an ever increasing commercial need for accurate sensing solutions.

This disclosure may solve the need by allowing precision sensors to be calibrated for accuracy when coupled with an economizer controller. This may be a digital economizer/DCV (demand controlled ventilation) controller that has a capability for manually calibrating individual sensors in the field.

The invention may be implemented in economizer firmware. When a customer would like to calibrate an individual sensor in an economizer/DCV system, the controller may be placed in calibration mode. Then the customer is able to calibrate each sensor to a reference. This calibration offset may then be stored in the firmware and used to compensate sensor data before submitted to the next level of firmware.

Figure 1:
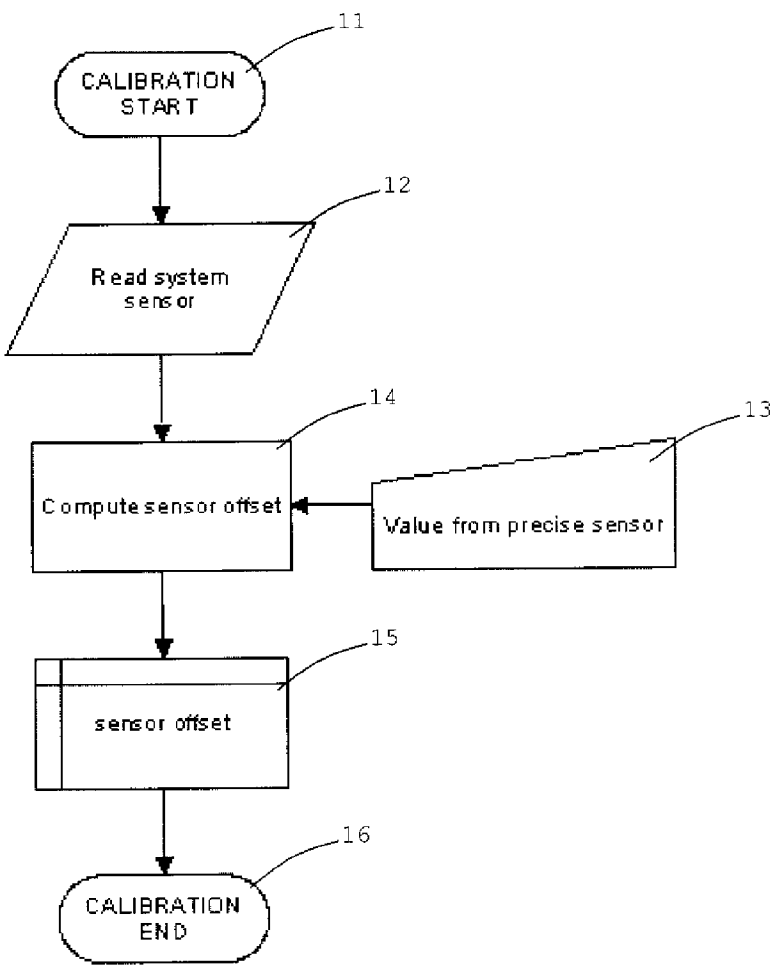
FIG. 1 is a diagram of obtaining a setting from a precision sensor.

FIG. 1 is a diagram of obtaining a setting from a precision sensor. A calibration start 11 may begin by going to read a system sensor at symbol 12. A precision sensor may be brought in and a value of the precision sensor may be obtained at symbol 13. With the value of the precision sensor, the system sensor offset may be computed at symbol 14. With the sensor offset at symbol 15, then one may be at a calibration end 16.

Figure 2:
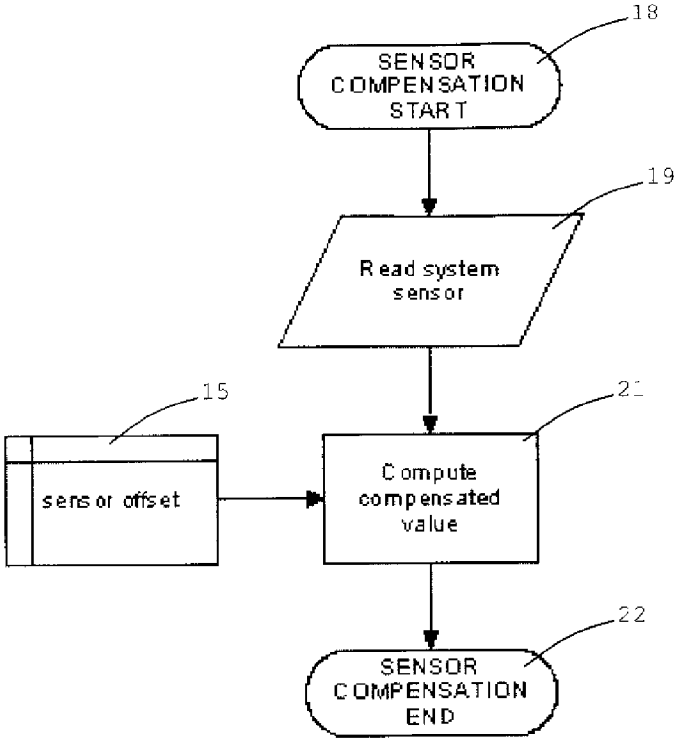
FIG. 2 is a diagram of compensating the system sensor.

FIG. 2 is a diagram of compensating the system sensor. A sensor compensation start 18 may begin by reading the system sensor at symbol 19. With the sensor offset at symbol 15, a compensated value of the system sensor may be computed at symbol 21. Then one may be at a sensor compensation end 22.

Figure 3:
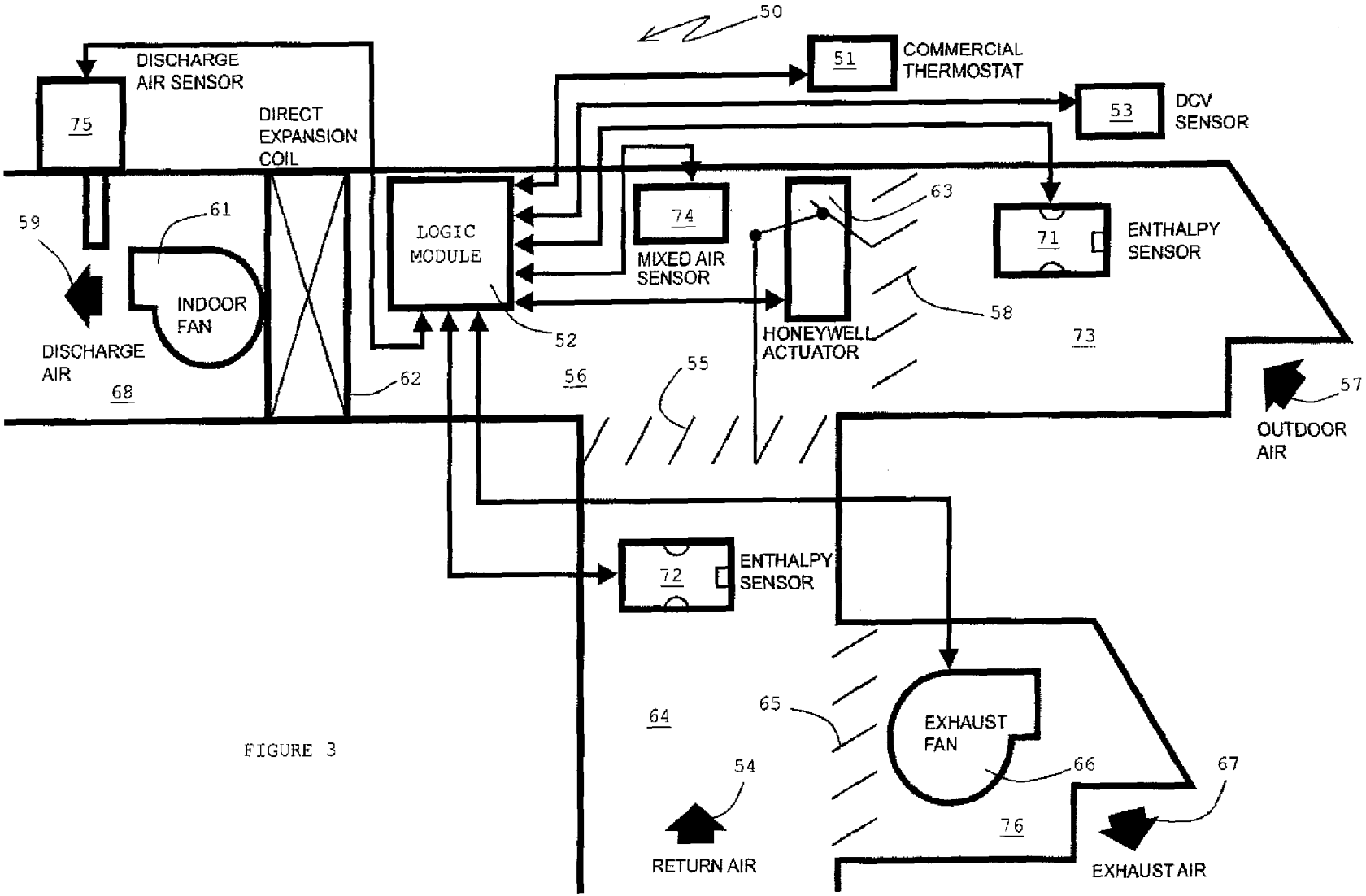
FIG. 3 is a schematic of a representative economizer system.

FIG. 3 is a schematic of a representative economizer system 50. A thermostat 51 may be connected to an economizer logic module 52. A demand control ventilation sensor 53 may be connected to module 52. Return air 54 may come in through a recirculation damper 55 into a mixing air chamber 56 where air 54 may be mixed with outdoor air 57 coming through an intake damper 58. Mixed air may be discharge air 59 which is drawn by an indoor fan 61 through a direct expansion coil 62 and provided to a space being conditioned via a supply duct 68. Dampers 55 and 58 may be controlled by an actuator 63 which is connected to module 52. Damper 58 may close as damper 55 opens and vice versa. A portion of return air 54 may taken from return air duct 64 and drawn through a damper 65 by an exhaust fan 66 through an exhaust duct 76 to outside the system as exhaust air 67. Exhaust fan 66 may be connected to module 52. The position of damper 65 may be determined at least in part by module 52. The proportions of outdoor air 57 and recirculated air 54 taken into supply duct 68, as well as the amount of air 67 from return air duct 64, may be controlled by intake damper 58, recirculation damper 55 and exhaust damper 65. An enthalpy sensor 71 situated in an intake or outdoor air duct 73 may be connected to module 52. For differential enthalpy, a second enthalpy sensor 72, along with enthalpy sensor 71, may be connected to module 52.

A mixed air sensor 74 may be situated in chamber or duct 56, or a discharge air sensor 75 may situated in chamber or duct 68, but not necessarily both. One or the other of or both sensors 74 and 75 may be connected to logic module 52. There may be situations where there would be both a mixed air sensor in the mixed air chamber and a separate discharge air sensor in the discharge chamber or duct. There may also be situations where there is not a discharge air sensor but that a mixed air sensor is mounted in the discharge chamber or duct.

Economizers may save energy in buildings by using cool outside air as a means of cooling the indoor space. When the enthalpy of the outside air is less than the enthalpy of the recirculated air, conditioning the outside air may be more energy efficient than conditioning recirculated air. When the outside air is both sufficiently cool and sufficiently dry (depending on the climate), the amount of enthalpy in the air is acceptable to the control, no additional conditioning of it is necessarily needed. This portion of the air-side economizer control scheme may be referred to as free cooling.

Economizers may reduce HVAC energy costs in cold and temperate climates while also potentially improving indoor air quality, but they might often not be appropriate in hot and humid climates. With the proper controls, economizers may be used in climates which experience various weather systems.

When the outside air's dry-bulb and wet-bulb temperatures are low enough, economizers may use water cooled by a wet cooling tower to cool buildings without operating a chiller. Often a plate-and-frame heat exchanger may be inserted between the cooling tower and chilled water loops.

To recap, the present calibrating mechanism for an economizer controller may have a precision sensor of a first kind and a first system sensor of the first kind of an economizer controller. The first system sensor may be read to obtain a first value in a first ambient environment at a first time. The precision sensor may be read to obtain a second value in the first ambient environment at the first time. The first value may be compared with the second value to obtain a first offset from a difference between the first and second values. The first system sensor may be read to obtain a third value at a second time. The third value of the first system sensor may be adjusted by incorporating the first offset to obtain a compensated third value of the first system sensor.

The calibrating mechanism may further have a second system sensor of the first kind of a second economizer controller. The second system sensor may be read to obtain a fourth value in a second ambient environment at a third time. The first system sensor may be read to obtain a fifth value in the second ambient environment at the third time. The fifth value of the first system sensor may be adjusted by incorporating the first offset to obtain a compensated fifth value of the first system sensor. The fourth value may be compared with the compensated fifth value to obtain a second offset from a difference between the fourth and compensated fifth values. The second system sensor may be read to obtain a sixth value at a fourth time. The sixth value of the second system sensor may be adjusted by incorporating the second offset to obtain a compensated sixth value of the second system sensor.

The first system sensor may be read to obtain a fourth value in the first ambient environment at a third time. The precision sensor may be read to obtain a fifth value in the first ambient environment at the third time. The fourth value of the first system sensor may be compared with the fifth value of the precision sensor to obtain a second offset from a difference between the fourth and fifth values.

The first and second offsets may be combined to provide a curve of offsets versus values from the first system sensor, which can be extrapolated for obtaining offsets for other values obtained by the first system sensor. The curve may be extrapolated for obtaining offsets for compensating various values from the first system sensor. The first system sensor may be read to obtain a sixth value at a fourth time. An offset may be determined from the curve for compensating the sixth value.

A sensor of the first kind may be a temperature sensor, a relative humidity sensor, a CO2 sensor, or the like.

The approach for calibrating a system sensor in an economizer controller may incorporate measuring a first parameter with a system sensor of an economizer controller to get a first reading, and measuring the first parameter with a precision sensor to get a second reading. It may further incorporate computing an offset from a difference between the first and second readings, entering the offset into a memory of the economizer controller, and using the offset for calibrating other readings from the system sensor.

The first reading from the system sensor may be an X. The second reading from the precision sensor may be a Y. $|X-Y|$ may be the offset. If X is greater than Y, then the offset may be subtracted from a subsequent reading from the system sensor for compensation of the subsequent reading. If Y is greater than X, then the offset may be added to a subsequent reading from the system sensor for compensation of the subsequent reading.

The readings of the precision sensor and the system sensor may be stored in the economizer controller. A determination for the offset from the readings of the precision sensor and the system sensor, and compensation of a subsequent reading of the system sensor may be automatically processed by the economizer controller.

The approach may further incorporate measuring the first parameter with the system sensor of the economizer controller to get a first reading at each of a plurality of ambient temperatures, and measuring the first parameter with the precision sensor to get a second reading at each of the plurality of ambient temperatures. Also, the approach may incorporate computing an offset from a difference between the first and second readings of the first parameter for each of the plurality of ambient temperatures, and using an offset, computed at a temperature of the plurality of ambient temperatures, for calibrating another reading from the system sensor of the first parameter obtained at the same temperature that the offset was computed. The first parameter may be a non-temperature parameter.

An approach for calibrating a system sensor of an economizer controller, may incorporate taking a plurality of readings with a system sensor of an economizer controller at a first set of different values of a parameter, and taking a plurality of readings with a precision sensor at the first set of different values of the parameter for the first set of different values. Then a plurality of offsets may be determined where each offset is a comparison of a reading from the system sensor and a reading from the precision sensor at a same time, of the parameter for the first set of different values. A reading from the system sensor of a certain value of the parameter may be compensated with an offset from the plurality of offsets for a value, of the first set of different values, most closely corresponding to the certain value.

The approach may further incorporate a graphing the plurality of offsets versus readings of the system sensor. Each offset of the plurality of offsets and each corresponding reading of the system sensor may be plotted as a point on a graph resulting in a plurality of points on the graph. A curve may be constructed that fits on the plurality of points on the graph. The plurality of offsets versus readings of the system sensor may be entered in a look-up table.

Compensating a reading from the system sensor of a certain value of the parameter with an offset from the plurality of offsets for a value corresponding to the certain value may be automatic by the economizer controller for each reading from the system sensor of the parameter.

The economizer controller may incorporate a user interface for placing the controller in a calibration mode for compensating a reading with an offset determined by a reading from each system sensor relative to a reading from the precision sensor. Offsets determined for readings of each system sensor may be stored at the controller for availability for compensating a reading from a system sensor at the controller in absence of the precision sensor.

The economizer controller may be a digital controller with demand controlled ventilation (DCV).

U.S. Pat. Nos. 6,161,764, 4,570,448, and 7,434,413 may be relevant. U.S. Pat. No. 6,161,764, issued Dec. 19, 2000, is hereby incorporated by reference. U.S. Pat. No. 4,570,448, issued Feb. 18, 1986, is hereby incorporated by reference. U.S. Pat. No. 7,434,413, issued Oct. 14, 2008, is hereby incorporated by reference.

In the present specification, some of the matter may be of a hypothetical or prophetic nature although stated in another manner or tense.

Although the present system has been described with respect to at least one illustrative example, many variations and modifications will become apparent to those skilled in the art upon reading the specification. It is therefore the intention that the appended claims be interpreted as broadly as possible in view of the prior art to include all such variations and modifications.

What is claimed is:

1. A calibrating mechanism for an economizer controller comprising:

a precision sensor of a first kind for measuring a control parameter of an HVAC system; and a first system sensor of the first kind for measuring the control parameter of an economizer controller of an HVAC system; and wherein:

the first system sensor is read to obtain a first value in a first ambient environment at a first time;

the precision sensor is read to obtain a second value in the first ambient environment at the same first time as the first system sensor;

the first value is compared with the second value to obtain a first offset from a difference between the first and second values;

the first system sensor is read to obtain a third value in the first ambient environment at a second time;

the precision sensor is read to obtain a fourth value in the first ambient environment at the same second time as the first system sensor;

the third value of the first system sensor is compared with the fourth value of the precision sensor to obtain a second offset from a difference between the third and fourth values, wherein the first and second offsets are combined to provide a curve of offsets versus values from the first system sensor, which is extrapolated for obtaining offsets for other values obtained by the first system sensor.

2. The mechanism of claim 1, further comprising:

a second system sensor of the first kind of a second economizer controller; and wherein:

the second system sensor is read to obtain a fifth value in a second ambient environment at a third time;

the first system sensor is read to obtain a sixth value in the second ambient environment at the third time;

the sixth value of the first system sensor is adjusted by incorporating a third offset to obtain a compensated sixth value of the first system sensor, wherein the third offset is obtained by extrapolating the curve of offsets to obtain an offset for the obtained sixth value;

the fifth value is compared with the compensated sixth value to obtain a fourth offset from a difference between the fifth and compensated sixth values; and the fifth value is adjusted by incorporating the fourth offset to obtain a compensated fifth value.

3. The mechanism of claim 1, wherein at least a third offset is obtained from a difference between values of the first system sensor and the precision sensor and at least three offsets are combined to provide the curve of offsets versus values from the first system sensor.

4. The mechanism of claim 1, wherein:

the first system sensor is read to obtain a fifth value at a third time; and an offset is determined from the curve for compensating the fifth value.

5. The mechanism of claim 1, wherein a sensor of the first kind is a temperature sensor.

6. The mechanism of claim 1, wherein a sensor of the first kind is a relative humidity sensor.

7. The mechanism of claim 1, wherein a sensor of the first kind is a CO2 sensor.

8. A method for calibrating a system sensor in an economizer controller, comprising:

measuring a first parameter for controlling an economizer/demand control ventilation system with a system sensor of an economizer controller to get a first reading at each of a plurality of ambient temperatures;

measuring the first parameter with a precision sensor to get a second reading at each of the plurality of ambient temperatures;

computing a plurality of offsets from a difference between the first and second readings of the first parameter for each of the plurality of ambient temperatures;

entering the offsets into a memory of the economizer controller; and using one of the computed plurality of offsets for calibrating another reading from the system sensor of the first parameter; and wherein computing the offsets from the readings of the precision sensor and the system sensor, and calibrating of a subsequent reading of the system sensor are automatically processed; and wherein each of the first and second readings are taken at a same time for each of the plurality of ambient temperatures.

9. The method of claim 8, wherein:

the readings of the precision sensor and the system sensor are stored in the economizer controller.

10. The method of claim 8, wherein using one of the computed plurality of offsets for calibrating another reading from the system sensor of the first parameter comprises using one of the computed plurality of offsets, computed at a temperature of the of the plurality of ambient temperatures, for calibrating another reading from the system sensor of the first parameter obtained at the same temperature that the offset was computed.

11. The method of claim 8, wherein the first parameter is a non-temperature parameter.

12. The method of claim 8, further comprising extrapolating a curve of offsets from the plurality of offsets; and wherein using one of the computed plurality of offsets for calibrating another reading from the system sensor of the first parameter comprises using an offset from the extrapolated curve of offsets for calibrating another reading from the system sensor of the first parameter.

13. The method of claim 12, wherein the offset from the extrapolated curve of offsets comprises an offset extrapolated for the same temperature at which the another reading from the system sensor of the first parameter was obtained.

14. A method for calibrating a system sensor of an economizer controller, comprising:

taking a plurality of readings with a system sensor of an economizer controller at a first set of different values of a parameter for controlling an economizer/demand control ventilation system;

taking a plurality of readings with a precision sensor at the first set of different values of the parameter for the first set of different values;

determining a plurality of offsets wherein each offset is a comparison of a reading from the system sensor and a reading from the precision sensor at a same time, of the parameter for the first set of different values; and compensating a reading from the system sensor of a certain value of the parameter with an offset from the plurality of offsets for a value, of the first set of different values, most closely corresponding to the certain value; and wherein each the plurality of readings with a precision sensor is taken at a same time as a corresponding reading taken with the system sensor.

15. The method of claim 14, further comprising:

a graphing the plurality of offsets versus readings of the system sensor; and wherein:

each offset of the plurality of offsets and each corresponding reading of the system sensor is plotted as a point on a graph resulting in a plurality of points on the graph; and a curve is constructed that fits on the plurality of points on the graph.

16. The method of claim 14, wherein the plurality of offsets versus readings of the system sensor are entered in a look-up table.

17. The method of claim 14, wherein the compensating a reading from the system sensor of a certain value of the parameter with an offset from the plurality of offsets for a value corresponding to the certain value is automatic by the economizer controller for each reading from the system sensor of the parameter.

18. The method of claim 14, wherein:

the economizer controller comprises a user interface for placing the controller in a calibration mode for compensating a reading with an offset determined by a reading from each system sensor relative to a reading from the precision sensor; and offsets determined for readings of each system sensor are stored at the controller for availability for compensating a reading from a system sensor at the controller in absence of the precision sensor.

19. The method of claim 14, wherein the economizer controller is a digital controller with demand controlled ventilation.

* * * * *